US008293153B2

(12) United States Patent
Isozumi

(10) Patent No.: US 8,293,153 B2
(45) Date of Patent: Oct. 23, 2012

(54) ROTARY POWDER COMPRESSION MOLDING MACHINE

(75) Inventor: Masatsugu Isozumi, Kyoto (JP)

(73) Assignee: Kikusui Seisakusho Ltd., Kyoto-Shi, Kyoto (JP)

( * ) Notice: Subject to any disclaimer, the term of this patent is extended or adjusted under 35 U.S.C. 154(b) by 244 days.

(21) Appl. No.: 12/662,125

(22) Filed: Mar. 31, 2010

(65) Prior Publication Data

US 2011/0001253 A1 Jan. 6, 2011

(30) Foreign Application Priority Data

Apr. 7, 2009 (JP) ..... P2009-092774
Mar. 16, 2010 (JP) ..... P2010-059197

(51) Int. Cl.
*B27N 3/00* (2006.01)

(52) U.S. Cl. ..... 264/109; 425/345

(58) Field of Classification Search ..... 425/345; 264/109

See application file for complete search history.

(56) References Cited

U.S. PATENT DOCUMENTS 4,099,239 A * 7/1978 Williams ..... 702/82
6,451,228 B1 * 9/2002 Hinzpeter et al. ..... 264/40.1
2006/0013914 A1 * 1/2006 Shimada et al. ..... 425/408

FOREIGN PATENT DOCUMENTS

WO WO 2008/038070 A1 3/2008
WO WO2008038070 * 4/2008

* cited by examiner

*Primary Examiner* — Joseph Del Sole
*Assistant Examiner* — David N Brown, II
(74) *Attorney, Agent, or Firm* — McGinn IP Law Group, PLLC

(57) ABSTRACT

A rotary powder compression molding machine according to the invention includes: a flame; a rotary shaft; a turret; a plurality of die; an upper and a lower punches; an upper and a lower rolls; a designator for designating a molding portion constituted of a set of the die and the upper and lower punches corresponding to the die; a position detector for detecting that the molding portion designated by the designator has reached a predetermined position; a separator for separating a designated molded article ejected from the molding portion designated by the designator from collection of molded articles other than the designated molded article based on a position detection signal output from the position detector; and an actuation verifier for verifying actuation of the separator based on movement of the designated molded article.

20 Claims, 8 Drawing Sheets

ROTARY POWDER COMPRESSION MOLDING MACHINE

BACKGROUND OF THE INVENTION

1. Field of the Invention

The present invention relates to a rotary powder compression molding machine that compresses a powder material to mold a tablet, food, an electronic component, or the like.

2. Description of the Related Art

Conventionally, in a rotary powder compression molding machine that compresses a powder material to mold tablets, for example, irregular tablets may be produced in some cases due to abnormal pressure in molding. Because such tablets cannot be treated as products, the tablets must be excluded from products. Therefore, a defective article eliminating device is mounted in the rotary powder compression molding machine. For example, there is a rotary powder compression molding machine as described in International Publication No. WO 2008/038070 in which a control valve is opened in response to a signal output from a control unit and air from a compressed air source is injected from a discharge nozzle via the control valve to eliminate the defective molded article.

In this rotary powder compression molding machine, a pressure gage is provided in a feed path between the compressed air source and the control valve so as to detect a failure of the control valve. Static pressure in the feed path is monitored based on an electric signal output from the pressure gage and a control unit outputs an error signal when the static pressure is lower than the minimum pressure set in advance.

In general, if the compression air is not injected from the discharge nozzle for some reason in the rotary powder compression molding machine, the defective article is not eliminated and collected together with conforming articles. For example, if the control valve fails, the compressed air is not injected from the discharge nozzle and the defective article is not eliminated. Therefore, the defective article may be mixed into the conforming articles and all the collected conforming articles may not be used as products because of the only one defective article in some cases.

In order to solve the problem described above, the machine in International Publication No. WO 2008/038070 measures pressure of the compressed air in a feed line connected to the discharge nozzle to verify whether or not the compressed air is injected from the discharge nozzle. In particular, if the pressure is low as a result of the measurement of the pressure in the feed line, it indicates that the control valve is open. If the pressure is high, it indicates that the control valve is closed or the discharge nozzle is clogged. In this way, whether or not the compressed air is injected is verified.

However, though it is possible to verify that the compressed air is injected from the discharge nozzle, it is impossible to verify whether or not a path of a target molded article has actually been changed or whether or not the target molded article has been retrieved.

Moreover, though International Publication No. WO 2008/038070 mentions taking out of a sample, it is impossible to verify whether or not the target sample has actually been retrieved for the same reason as the above.

SUMMARY OF THE INVENTION

Therefore, it is an object of the present invention to solve such problems.

Specifically, the present invention provides a rotary powder compression molding machine including: a frame; a rotary shaft rotatably mounted in the frame; a turret mounted to the rotary shaft; a plurality of dies provided at predetermined intervals in a circumferential direction of the turret; an upper punch and a lower punch retained in positions above and below each of the dies to be movable in a vertical direction; an upper roll and a lower roll for biasing the upper punch and the lower punch toward each other with tip ends of the upper punch and the lower punch inserted in the die to compress a powder material filled in the die; a designator for designating a molding portion constituted of a set of the die and the upper and lower punches corresponding to the die; a position detector for detecting that the molding portion designated by the designator has reached a predetermined position; a separator for separating a designated molded article ejected from the molding portion designated by the designator from collection of molded articles other than the designated molded article based on a position detection signal output from the position detector; and an actuation verifier for verifying actuation of the separator based on movement of the designated molded article.

In this configuration, the actuation verifier determines whether or not the actuation of the separator is normal based on the movement of the designated molded article and therefore it is possible to accurately determine a trouble of the separator.

If the trouble occurs in the separator, it is impossible to separate the designated molded article from the molded articles other than the designated molded article and a path of the designated molded article after the passage of the designated molded article through a separating position is the same as a path of the molded articles other than the designated molded article. Therefore, the actuation verifier can determine whether or not the actuation of the separator is normal.

Therefore, it is possible to detect a trouble when the path of the designated molded article did not change, though compressed air was injected from a discharge nozzle, for example, to thereby solve the prior-art problem.

Specifically, determination of the actuation of the separator is carried out by the actuation verifier that outputs an abnormality verification signal when it verifies that the separator was not actuated normally and outputs a normality verification signal when it verifies that the separator was actuated normally.

The designator may include a pressure detector for detecting that pressure applied on the powder material when the upper punch and the lower punch pass between the upper roll and the lower roll is predetermined pressure, for example.

The position detector preferably includes an angle measure for measuring a rotation angle of the turret or a pulse measure for measuring a position of the molding portion by measuring pulses generated by rotation of the turret, for example. The pulse measure preferably includes a rotary encoder for detecting the rotation angle of the rotary shaft.

Moreover, the machine may further include a separation determination circuit for outputting a counting start signal based on the position detection signal output from the position detector and the actuation verifier may include a passage sensor, which outputs a passage signal when it detects passage of the designated molded article, in a predetermined position in a vicinity of a tip end of an air passage of a guide member and check the counting start signal and the passage signal output from the passage sensor against each other to output the abnormality verification signal or the normality verification signal. The passage sensor is preferably disposed in a position in the vicinity of the tip end of the air passage of the guide member and closer to the molded article collecting position.

In this configuration, preferably, the actuation verifier further includes a passage sensor which is different from the passage sensor and which is disposed between a designated molded article separating position for separating the designated molded article from the molded articles other than the designated molded article and a designated molded article collecting position for collecting the designated molded article.

Moreover, a shooting device is preferably mounted in a predetermined position in a vicinity of the passage sensor besides or in place of the passage sensor(s) and the actuation verifier verifies the passage or a moving direction of the molded article or the designated molded article with the shooting device. A position that the shooting device monitors is preferably a vicinity of the designated molded article collecting position. The shooting device may monitor the designated molded article collecting position to thereby monitor the moving direction of the molded article or the designated molded article.

By mounting the shooting device, it is possible to visually determine whether or not the separator is actuated normally and whether or not the respective passage sensors are actuated normally.

The shooting device is preferably a high-speed camera.

The invention provides a method of verifying actuation of molded article separation in a rotary powder compression molding machine including: a frame; a rotary shaft rotatably mounted in the frame; a turret mounted to the rotary shaft; a plurality of dies provided at predetermined intervals in a circumferential direction of the turret; an upper punch and a lower punch retained in positions above and below each of the dies to be movable in a vertical direction; and an upper roll and a lower roll for biasing the upper punch and the lower punch toward each other with tip ends of the upper punch and the lower punch inserted in the die to compress a powder material filled in the die, the method including the steps of: designating a molding portion constituted of a set of the die and the upper and lower punches corresponding to the die; detecting that the designated molding portion has reached a designated molded article separating position; separating a designated molded article ejected from the designated molding portion from collection of molded articles other than the designated molded article based on designation of the molding portion and a result of the detection; verifying whether or not the separation has been carried out normally based on a path of the designated molded article; and outputting an abnormality verification signal when the separation was not normal and/or a normality verification signal when the separation was normal.

The invention provides a method of verifying actuation of molded article separation in a rotary powder compression molding machine including: a frame; a rotary shaft rotatably mounted in the frame; a turret mounted to the rotary shaft; a plurality of dies provided at predetermined intervals in a circumferential direction of the turret; an upper punch and a lower punch retained in positions above and below each of the dies to be movable in a vertical direction; and an upper roll and a lower roll for biasing the upper punch and the lower punch toward each other with tip ends of the upper punch and the lower punch inserted in the die to compress a powder material filled in the die, the method including the steps of: designating a molding portion constituted of a set of the die and the upper and lower punches corresponding to the die; detecting that the designated molding portion has reached a designated molded article separating position; separating a designated molded article ejected from the designated molding portion from collection of molded articles other than the designated molded article based on designation of the molding portion and a result of the detection; verifying whether or not the separation has been carried out normally based on a path of the designated molded article; and outputting a normality verification signal when the separation was normal.

The powder material in the invention refers to an aggregate of minute solids and includes an aggregate of particles such as what they call granules and an aggregate of powder smaller than the particles.

The present invention is configured as described above and can reliably verify that the trouble occurred in the separator. Therefore, it is possible to prevent mixing of the designated molded article to be separated into the molded articles other than the designated molded article.

As a result, it is possible to separate the designated molded article and the molded articles other than the designated molded article from each other. If abnormal pressure is detected in a certain molding portion, for example, it is possible to separate a defective article (designated molded article) ejected from the molding portion from conforming articles (molded articles other than the designated molded article). Moreover, this technique can be used for taking out of part of molded articles such as sampling as well.

Furthermore, it is also possible to take out a molded article in a certain molding portion after the turret rotated a few times depending on a method of selecting the molding portion.

DETAILED DESCRIPTION OF THE PREFERRED EMBODIMENT

An embodiment of the present invention will be described below with reference to FIGS. 1 to 5.

In an embodiment described below, a pressure detector is used as an example of a designator, an angle measure is used as an example of a position detector, a high-speed camera is used as an example of a shooting device, and a designated molded article molded under pressure (abnormal pressure) other than predetermined pressure is separated from molded articles other than the designated molded article and molded under the predetermined pressure.

The present invention is not limited to the embodiment described below.

Figure 1:
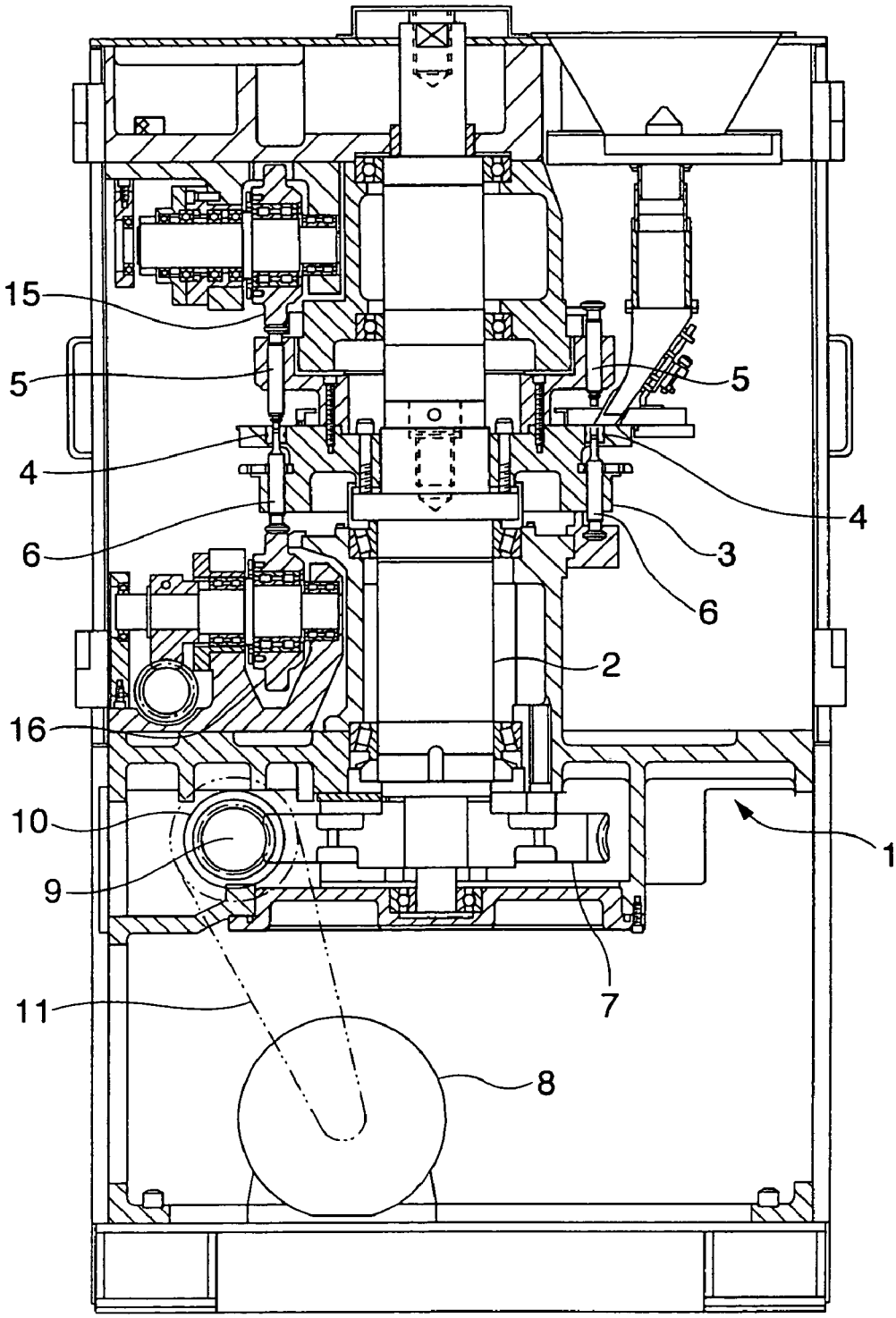
FIG. 1 is a cross-sectional view of a molding machine main body of a powder compression molding machine according to an embodiment of the present invention.

As shown in FIG. 1, in a rotary powder compression molding machine, an upright shaft 2 that is a rotary shaft is rotatably disposed in a frame 1 and a turret 3 is mounted on the upright shaft 2. The turret 3 is in a disk shape and a plurality of cylindrical dies 4 are mounted at predetermined intervals in a circumferential direction on a portion of the turret 3 near an outer periphery. The turret 3 retains upper punches 5 for the respective dies 4 above the portions where the dies 4 are mounted so that the upper punches 5 are movable in a vertical direction and retains lower punches 6 for the respective dies 4 under the portions where the dies 4 are mounted so that the lower punches 6 are movable in the vertical direction. In other words, a pair of upper punch 5 and lower punch 6 is provided for each die 4. A tip of the upper punch 5 comes into and goes out of the die 4 and a tip of the lower punch 6 is inserted into the die 4 all the time. A molding portion is constituted of a set of the die 4, the upper punch 5, and the lower punch 6 corresponding to the die 4.

Figure 2:
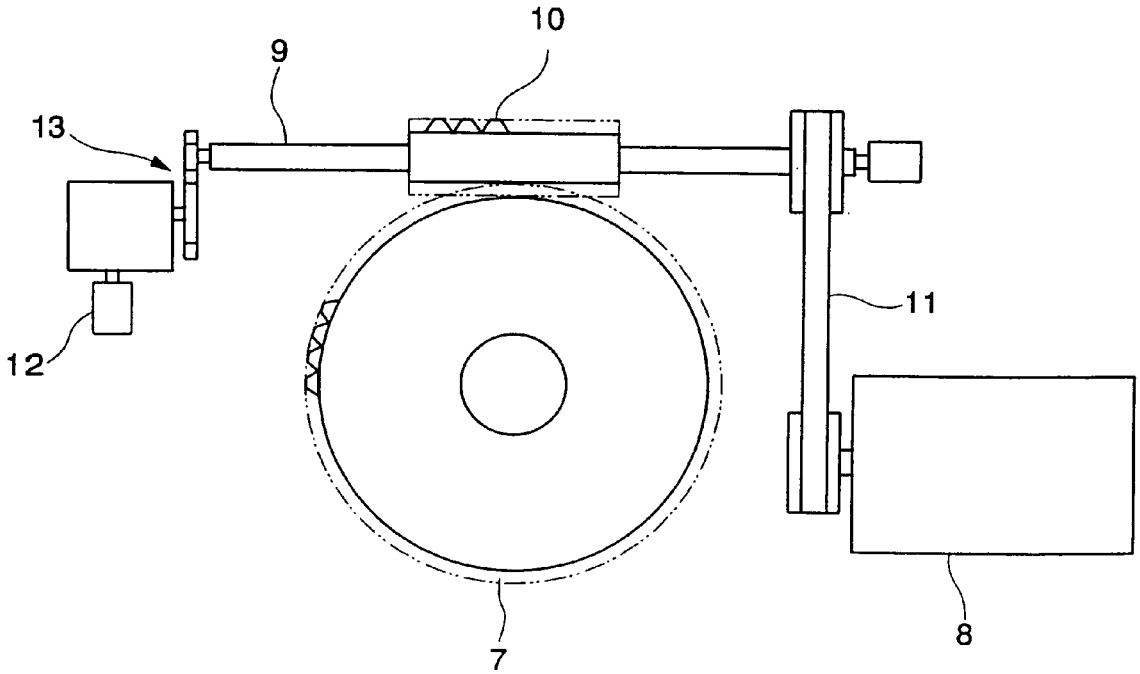
FIG. 2 is a plan view of an essential portion illustrating a mounted position of a rotary encoder in the embodiment.

A worm wheel 7 is mounted on a lower end of the upright shaft 2. With the worm wheel 7, a worm gear 10 mounted on a gear shaft 9 driven by a motor 8 is engaged as shown in FIG. 2. A drive force of the motor 8 is transmitted to the gear shaft 9 by way of a belt 11. Connected to an end portion of the gear shaft 9 via a reduction device 13 is a rotary encoder 12 for converting rotation of the gear shaft 9 into at least one pulse train. The rotary encoder 12 outputs a pulse train in response to rotation of the gear shaft 9 and therefore can be thought to be outputting the pulse train corresponding to a rotation angle of the upright shaft 2. Consequently, by counting the number of pulse trains output from the rotary encoder 12, it is possible to measure the rotation angle of the upright shaft 2 and a rotation angle of the turret 3 as well. The reduction device 13 reduces rotating speed of the gear shaft 9 to adapt it to speed of input to the rotary encoder 12 and transmits it to the rotary encoder 12.

Figure 3:
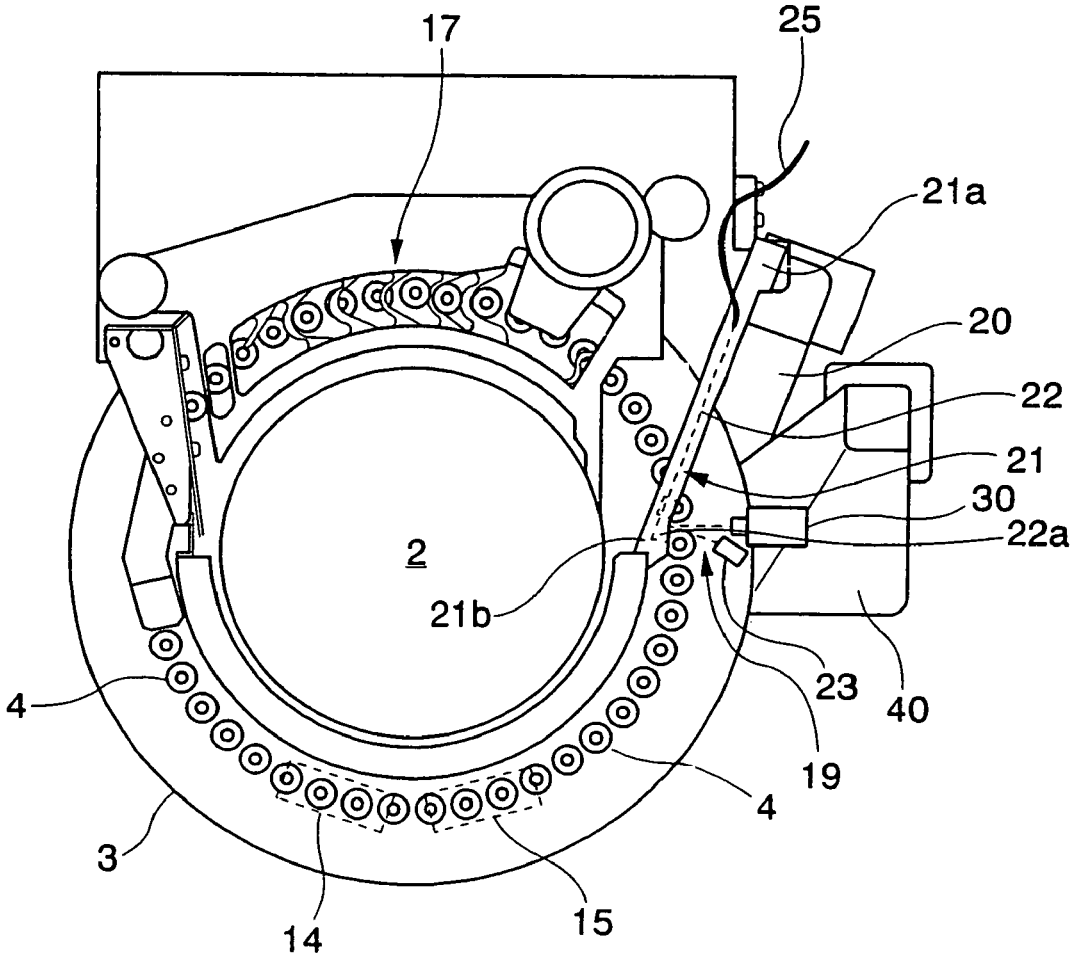
FIG. 3 is a plan view of an essential portion illustrating a plane configuration around a turret in the embodiment.

In predetermined positions in a rotating direction of the turret 3, a pre compression upper roll 14 and a pre compression lower roll (not shown) pairing up with each other and a main compression upper roll 15 and a main compression lower roll 16 pairing up with each other are disposed to sandwich the upper punches 5 and the lower punches 6. As shown in FIG. 3, the pre compression upper roll 14 and the pre compression lower roll and the main compression upper roll 15 and the main compression lower roll 16 bias the upper punch 5 and the lower punch 6 toward each other with the tips of the upper punch 5 and the lower punch 6 inserted into the die 4 so that the upper punch 5 and the lower punch 6 compress the powder material filled in the die 4. For this purpose, the pre compression upper roll 14 and the pre compression lower roll and the main compression upper roll 15 and the main compression lower roll 16 are provided in advanced positions in the rotating direction of the turret 3 with respect to a powder material filling portion 17 for filling the powder material into the dies 4. The main compression upper roll 15 and the main compression lower roll 16 are provided in advanced positions in the rotating direction of the turret 3 with respect to the pre compression upper roll 14 and the pre compression lower roll. The main compression upper roll 15 is provided with a load cell 18 forming a pressure detector for detecting pressure applied on the main compression upper roll 15 in the compression of the powder material. The load cell 18 detects the pressure applied on the main compression upper roll 15 to thereby detect pressure applied on the powder material that is compressed while the upper punch 5 and the lower punch 6 pass between the upper roll 15 and the lower roll 16.

Figure 4:
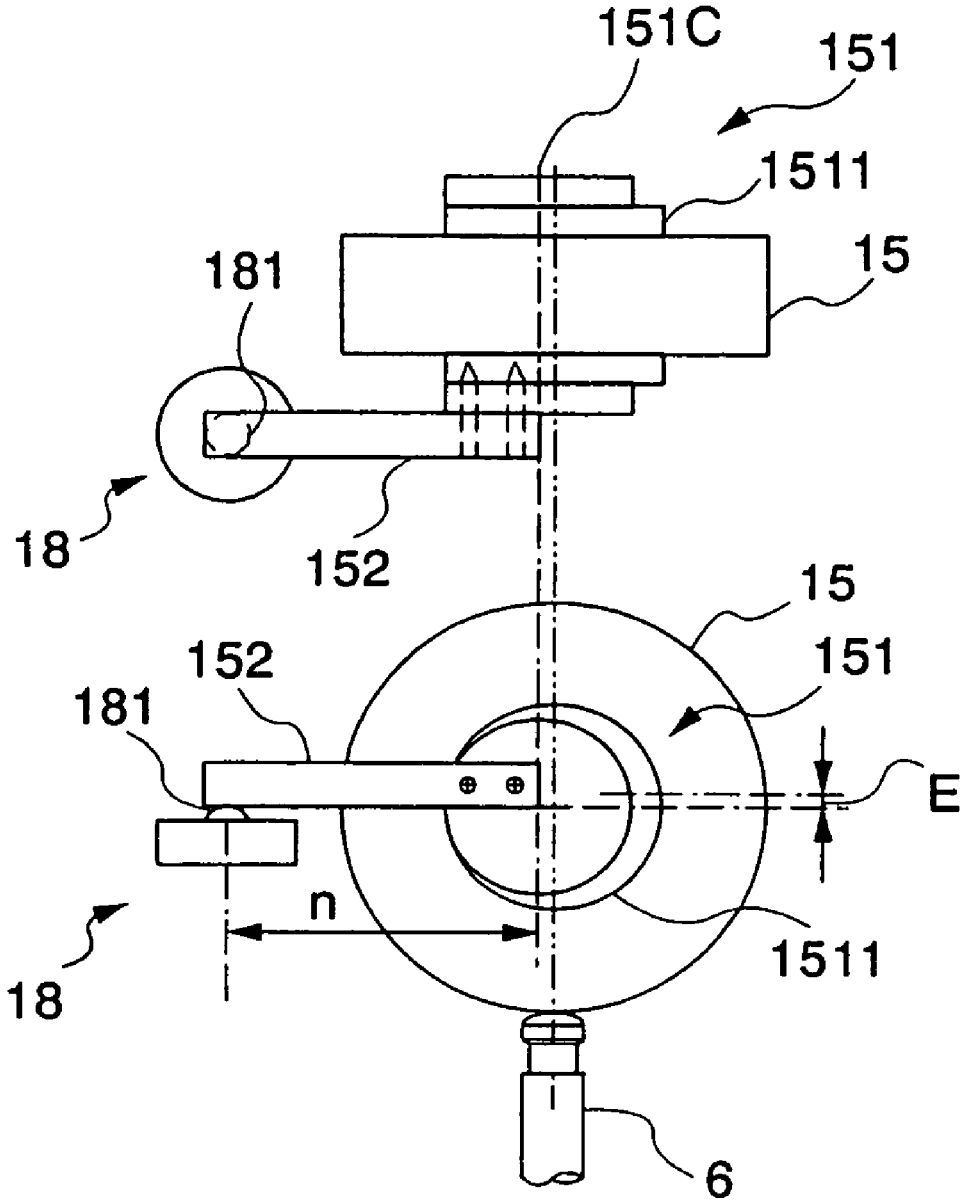
FIG. 4 is a plan view and a side view illustrating a schematic configuration of a molding pressure detecting portion in the embodiment.

The load cell 18 forming the pressure detector is disposed in a position away from a spindle 151 for supporting the upper roll 15 as shown in FIG. 4 and detects the pressure applied on the powder material through the spindle 151 and a turning arm 152. In other words, the spindle 151 has an eccentric portion 1511 and the upper roll 15 is rotatably fitted over the eccentric portion 1511. On an end portion of the spindle 151, the turning arm 152 is mounted to extend outward in a perpendicular direction to a central axis 151C of the spindle 151. The load cell 18 is disposed on a free end side of the turning arm 152 and a load receiving portion 181 of the load cell 18 is in contact with the free end of the turning arm 152.

In this configuration, if a distance from the central axis 151C to the load receiving portion 181 is n times an amount E of eccentricity of the upper roll 15, pressure detected by the load cell 18 is P/n when pressure P is applied on the powder material. The pressure applied on the powder material can be displayed on a display (not shown) by multiplying the pressure P/n detected by the load cell 18 by a multiplying factor n (a coefficient of the distance from the central axis 151C to the load receiving portion 181) stored in advance in a storage device (not shown).

In an advanced position of the turret 3 with respect to the position of pressurization by the main compression upper roll 15 and the main compression lower roll 16, a product ejecting portion 19 is formed. In the product ejecting portion 19, the lower punch 6 moves up until its tip end is substantially aligned with an upper end of the die 4 to eject a molded article in the die 4 from the die 4. The product ejecting portion 19 is provided with a guide member 21 for guiding the ejected molded articles to a molded article collecting position 20 for collecting the articles. The guide member 21 has a tip end extending toward a center of the turret 3 beyond a path of the dies 4. Therefore, the molded article pushed out of the die 4 by the lower punch 6 comes in contact with the guide member 21 and reliably moves toward the molded article collecting position 20. Inside the guide member 21, an air passage 22 through which pressurized air for separating a designated molded article molded under abnormal molding pressure out of molded articles passes is formed and a passage sensor 23 that can detect passage of the molded article is provided in a vicinity of a tip end 22*a* of the air passage 22.

Besides the passage sensor 23 or in place of the passage sensor 23, a high-speed camera 30 may be disposed in a predetermined position in a vicinity of the passage sensor 23 and the high-speed camera 30 may check the passage or a moving direction of the molded article or the designated molded article. The predetermined position in the vicinity of the passage sensor 23 is such a position as to be able to monitor the molded article or the designated molded article between a designated molded article separating position and a molded article collecting position 20.

The air passage 22 forms a separator for separating the designated molded article, extends from a mounted end 21*a* of the guide member 21 to a tip end portion 21*b* of the guide member 21, and is open outward in a radial direction of the turret 3 at the tip end portion 21*b*. A tip end 22*a* of the air passage 22 functions as an injection nozzle of the pressurized air, corresponds to the designated molded article separating position, and serves as an injecting portion for injecting the pressurized air. The designated molded article separating position is set in a position where the molded article ejected from the die 4 comes in contact with the guide member 21 for the first time. Provided on a radially outside of the designated molded article separating position is a designated molded article collecting position 40 for receiving the separated designated molded article.

The pressurized air prepared in an air feed source 24 is fed into the air passage 22 via a conduit 25 and a control valve 26.

The control valve 26 forming a separator is electrically connected to a controller 27, is connected to the air feed source 24 in terms of fluid engineering, and opens only when it receives a valve control signal output from the controller 27 to let the pressurized air through. Although the control valve 26 is preferably mounted to the tip end 22*a* of the air passage 22, it may be mounted in a position near the tip end 22*a*.

The passage sensor 23 includes a light emitting device 23*a* such as a light emitting diode and alight receiving device 23*b* such as a phototransistor which light emitted from the light emitting device 23*a* enters after reflecting from the molded article. Here, the light emitting device 23*a* may constantly emit the light. When the light receiving device 23*b* receives the light emitted from the light emitting device 23*a*, the passage sensor 23 outputs a passage signal to an actuation verification circuit 27*c* described later.

The passage sensor 23 detects movement of the molded article moving toward the molded article collecting position 20 while guided by the guide member 21 and is disposed in a position near the tip end 22*a* of the air passage 22 and closer to the molded article collecting position 20. Moreover, the light emitting device 23*a* is disposed in a position closer to the molded article collecting position 20.

Figure 5:
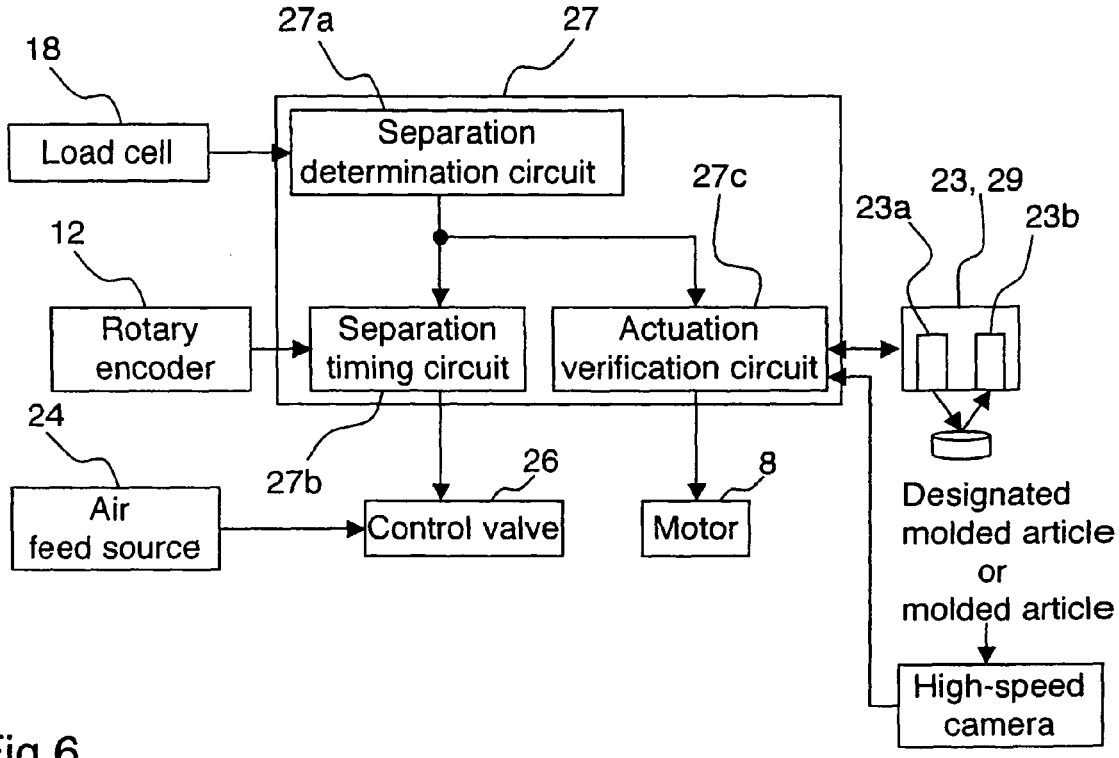
FIG. 5 is a block diagram illustrating a configuration of a controller in the embodiment.

As shown in FIG. 5, the controller 27 includes a separation determination circuit 27*a*, a separation timing circuit 27*b*, and an actuation verification circuit 27*c*. The separation determination circuit 27*a* compares the electric signal output from the load cell 18 and a separation set value set as a reference of separation of the designated molded article and detects that the pressure applied on the powder material when the upper punch 5 and the lower punch 6 pass between the main compression upper roll 15 and the main compression lower roll 16 is abnormal pressure. Here, the abnormal pressure is pressure applied on the powder material and higher than predetermined pressure set in advance or pressure applied on the powder material and lower than predetermined pressure set in advance.

The separation determination circuit 27*a* sets an upper separation set value and a lower separation set value in order to detect the abnormal pressure.

Here, the upper separation set value is such a set value that pressure applied on the powder material and higher than this predetermined pressure is determined to be the abnormal pressure and the lower separation set value is such a set value that pressure applied on the powder material and lower than this predetermined pressure is determined to be the abnormal pressure.

If the separation determination circuit 27*a* detects the abnormal pressure, i.e., detects a molding portion under the abnormal pressure, it outputs counting start signals to the separation timing circuit 27*b* and the actuation verification circuit 27*c*.

In this case, the designator is implemented by the pressure detector and the pressure detector is constituted of the load cell 18.

If the separation timing circuit 27*b* receives the counting start signal output from the separation determination circuit 27*a*, it starts counting pulses output from the rotary encoder 12 forming the angle measure to measure a position of the molding portion and outputs the valve control signal to the control valve 26 when the number of counted pulses reaches a predetermined number. Here, the rotary encoder 12 measures the rotation angle of the turret 3 based on the pulses and the predetermined number is set to the number of pulses corresponding to an angle between the position of pressurization and the designated molded article separating position.

In this case, the position detector is constituted of the rotary encoder 12.

If the actuation verification circuit 27*c* receives the counting start signal output from the separation determination circuit 27*a* and the passage signal output from the passage sensor 23, it outputs a stop signal for stopping energization of the motor 8. In other words, the actuation verification circuit 27*c* verifies that the separator was not actuated normally when it receives both the counting start signal and the passage signal. A verification signal (abnormality verification signal) from the actuation verifier in the embodiment is the stop signal output from the actuation verification circuit 27*c*.

Here, if a trouble has occurred in any one of the air passage 22, the air feed source 24, and the control valve 26 forming the separator, the actuation verification circuit 27*c* can verify that the separator is not normal and outputs the abnormality verification signal.

Although the abnormality verification signal is output when it is verified that the separator is not normal in the embodiment, a normality verification signal may be output when it is verified that the separator is normal.

The actuation verifier is constituted of the passage sensor 23 and the actuation verification circuit 27*c*.

In this configuration, if the rotary powder compression molding machine operates, the electric signal from the load cell 18 is input to the separation determination circuit 27*a* of the controller 27 every time the detected molding portion passes between the main compression upper roll 15 and the main compression lower roll 16. The separation determination circuit 27*a* compares the input electric signal with the upper separation signal and the lower separation signal and outputs the counting start signals to the separation timing circuit 27*b* and the actuation verification circuit 27*c* when the electric signal is higher than the upper separation signal or when the electric signal is lower than the lower separation signal. The separation timing circuit 27*b* starts counting the input pulses when it receives the counting start signal. Then, when the number of counted pulses reaches the predetermined number, the separation timing circuit 27*b* outputs the valve control signal to the control valve 26 for a predetermined time. At this time, the designated molded article has been ejected from the die 4 and reached the designated molded article separating position. Substantially simultaneously with contact of the designated molded article with the guide member 21, the control valve 26 opens based on the valve control signal from the separation timing circuit 27*b*. As a result, the pressurized air fed from the air feed source 24 is injected from the end portion of the air passage 22 on the side of the molded article separating position, i.e., from the tip end 22*a* to blow the designated molded article to be separated to the designated molded article collecting position 40. The predetermined time is long enough to blow the designated molded article to the designated molded article collecting position 40 and is the time until the next molded article comes in contact with the guide member 21.

In this way, it is possible to separate the designated molded article and the molded articles other than the designated molded article from each other. In other words, the pressurized air is injected only to the designated molded article and the pressurized air is not blown on the molded articles passing by the tip end 22*a* of the air passage 22 before and after the designated article. As a result, the molded articles other than the designated molded article and passing through the designated molded article separating position are not erroneously blown toward the designated molded article collecting position 40 and it is possible to separate the designated molded article and the molded articles other than the designated molded article from each other.

Moreover, because the rotary encoder 12 measures the rotation angle of the turret 3 via the gear shaft 9, the worm wheel 7, and the worm gear 10, it is easy to adapt to another turret as a replacement and having the different numbers of dies 4, upper punches 5, and lower punches 6 by newly setting a predetermined value to be compared with the number of counted pulses.

On the other hand, an example in which the control valve 26 forming the separator is not actuated even though the separation determination circuit 27*a* detected the abnormal pressure (detection of the molding portion) will be described.

When the electric signal from the load cell 18 is input to the separation determination circuit 27*a* of the controller 27 and the electric signal is outside an acceptable range of the signal defined by the above-described upper and lower separation signals, the separation determination circuit 27*a* outputs the counting start signal. Then, as described above, the separation timing circuit 27*b* outputs the valve control signal to the control valve 26. However, if the control valve 26 does not open when it receives the valve control signal, the designated molded article is not separated and tries to move along the guide member 21.

If the actuation verification circuit 27*c* receives the counting start signal output from the separation determination circuit 27*a*, it measures an elapsed time from the reception of the signal, i.e., the detection of the abnormal pressure in molding. Then the actuation verification circuit 27*c* outputs the stop signal for stopping energization of the motor 8 if it receives the passage signal output from, the passage sensor 23 when a predetermined time has elapsed. In particular, if the control valve 26 does not open and the pressurized air is not injected from the tip end 22*a*, the designated molded article follows the same path as the molded articles other than the designated molded article along the guide member 21. Then, if the light emitted from the light emitting device 23*a* of the passage sensor 23 reflects from the designated molded article and enters the light receiving device 23*b*, the passage sensor 23 detects the movement and the passage sensor 23 sends the passage signal to the actuation verification circuit 27*c*. Then, the actuation verification circuit 27*c* verifies the trouble, i.e., the failure of the separator including the control valve 26 when it receives the counting start signal output from the separation determination circuit 27*a* and receives the passage signal from the passage sensor 23 when the predetermined time has elapsed.

On the other hand, the actuation verification circuit 27*c* verifies that the control valve 26 is actuated normally when it receives the counting start signal output from the separation determination circuit 27*a* and does not receive the passage signal from the passage sensor 23 when the predetermined time has elapsed.

Here, in order to verify that the designated molded article has passed through an area between the designated molded article separating position to the designated molded article collecting position, it is preferable to mount a passage sensor 29 besides the passage sensor 23 in this area.

Alternatively, a high-speed camera 31 may be disposed in a predetermined position in a vicinity of the passage sensor 29 besides or in place of the passage sensor 29 so that the high-speed camera 31 verifies the passage or a moving direction of the molded article or the designated molded article. The predetermined position in the vicinity of the passage sensor 29 is such a position as to be able to monitor the molded article or the designated molded article between the designated molded article separating position and the designated molded article collecting position 40.

Next, if the high-speed camera 30 is disposed in place of the passage sensor 23, the actuation verification circuit 27*c* processes an image signal from the high-speed camera 30 with an image processor. Therefore, the actuation verification circuit 27*c* verifies the trouble, i.e., the failure of the separator including the control valve 26 when it receives the counting start signal output from the separation determination circuit 27*a* and receives the image signal from the high-speed camera 30 when the predetermined time has elapsed.

If the high-speed camera 30 is disposed in the predetermined position in the vicinity of the passage sensor 23 besides the passage sensor 23, the actuation verification circuit 27*c* processes the image signal from the high-speed camera 30 with an image processor. Therefore, the actuation verification circuit 27*c* verifies the trouble, i.e., the failure of the separator including the control valve 26 when it receives the counting start signal output from the separation determination circuit 27*a* and receives the image signal from the high-speed camera 30 when the predetermined time has elapsed. In this way, it is possible to verify that the separator does not have a trouble by way of both the passage sensor 23 and the high-speed camera 30, which further improves reliability of the machine.

In this case, if the trouble of the separator is verified by way of either one of the passage sensor 23 and the high-speed camera 30, the turret 3 is stopped.

Next, if the high-speed camera 31 is disposed in place of the passage sensor 29, the actuation verification circuit 27*c* processes an image signal from the high-speed camera 31 with an image processor. Therefore, the actuation verification circuit 27*c* verifies that the separator including the control valve 26 is actuated normally when it receives the counting start signal output from the separation determination circuit 27*a* and receives the image signal from the high-speed camera 31 when the predetermined time has elapsed.

If the high-speed camera 31 is disposed in the predetermined position in the vicinity of the passage sensor 29 besides the passage sensor 29, the actuation verification circuit 27*c* processes the image signal from the high-speed camera 31 with an image processor. Therefore, the actuation verification circuit 27*c* verifies that the separator including the control valve 26 is actuated normally when it receives the counting start signal output from the separation determination circuit 27*a* and receives the image signal from the high-speed camera 31 when the predetermined time has elapsed. In this way, it is possible to verify that the separator does not have a trouble by way of both the passage sensor 29 and the high-speed camera 31, which further improves reliability of the machine.

In this case, if the trouble of the separator is verified by way of either one of the passage sensor 29 and the high-speed camera 31, the turret 3 is stopped. If all of the passage sensors 23 and 29 and the high-speed cameras 30 and 31 are mounted, the turret 3 is stopped when the trouble of the separator is verified by way of any one of them.

As described above, because the movement of the designated molded article is observed and the trouble of the control valve 26 and eventually the trouble of the separator is indirectly detected, it is possible to reliably stop the motor 8, i.e., the turret 3 when the air feed source 24 has failed and the designated molded article cannot be separated even if the control valve 26 is open or when the tip end 22*a* of the air passage 22 is clogged with the powder material.

Because the movement of the designated molded article is observed in order to verify the trouble of the actuation of the separator in this configuration, it is unnecessary to separately observe the air passage 22, the air feed source 24, and the control valve 26 forming the separator. Therefore, it is possible to simplify a configuration of the actuation verifier. Moreover, by preventing the designated molded article (e.g., a defective article) from reaching the molded article collecting position 20 before it happens, it is possible to prevent mixing of the designated molded article into the molded articles other than the designated molded article and it is possible to prevent spoiling of the molded articles (e.g., conforming articles) other than the designated molded articles and collected before, which increases yield.

Figure 6:
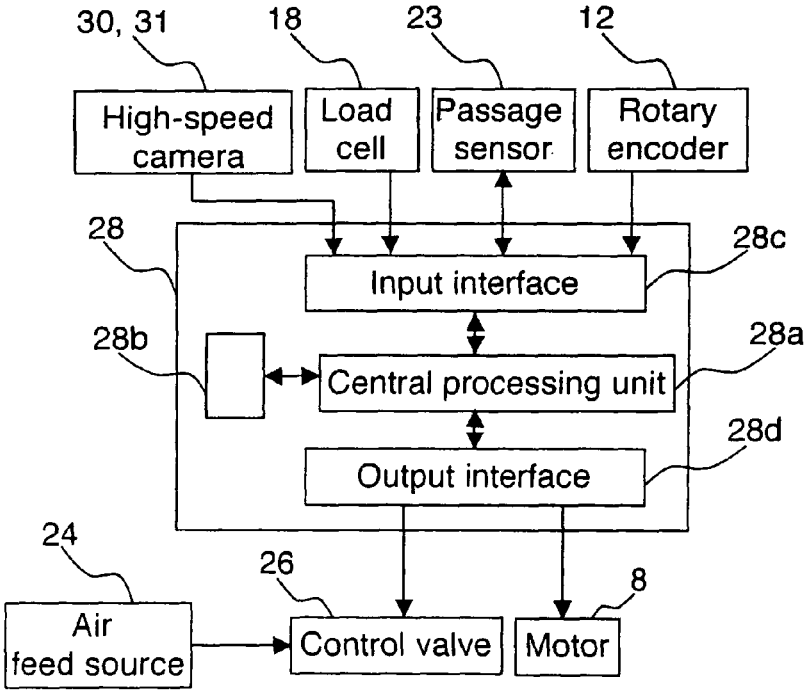
FIG. 6 is a block diagram illustrating another configuration of the controller in the embodiment.
Figure 7:
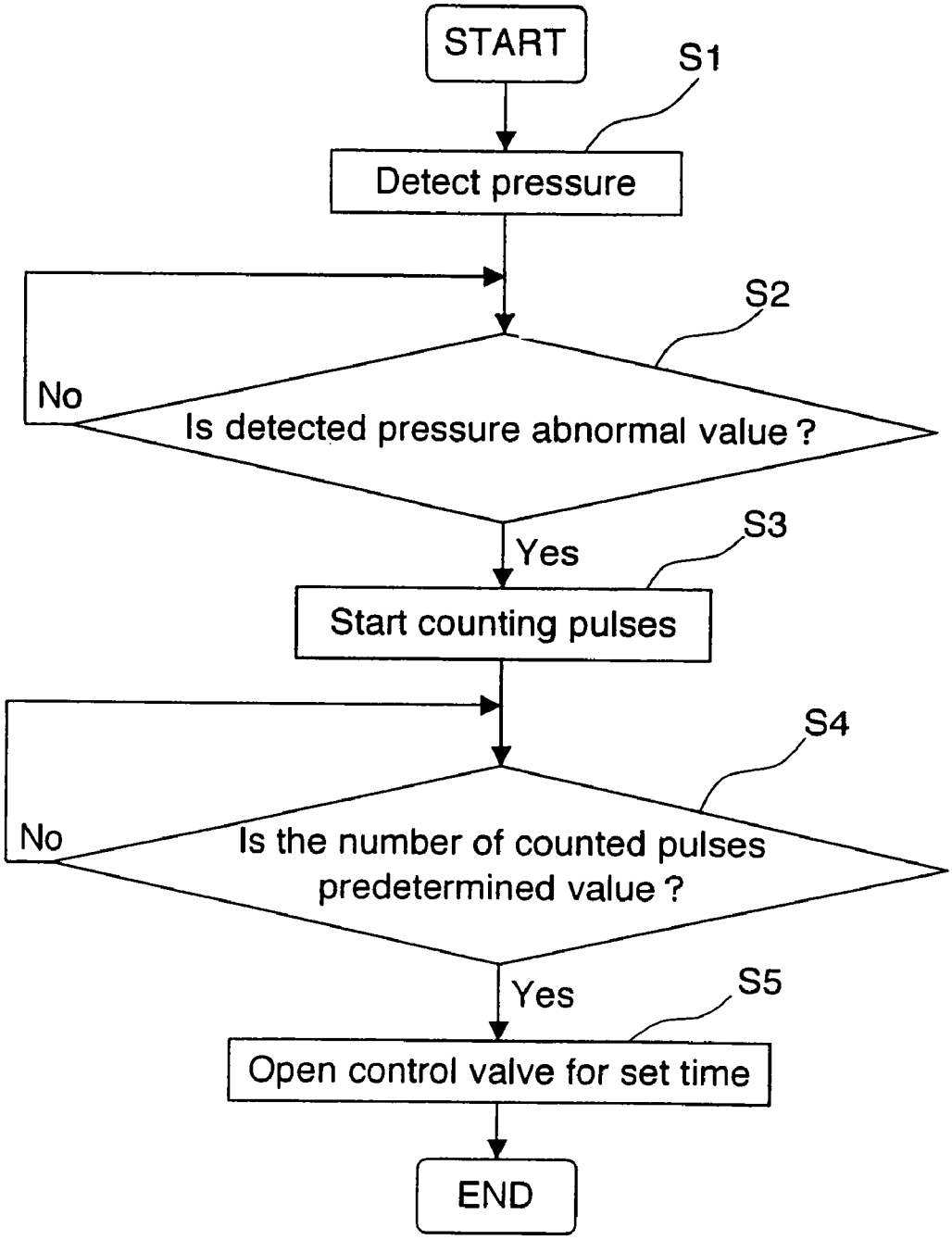
FIG. 7 is a schematic flow chart illustrating a control procedure in the controller shown in FIG. 6.
Figure 8:
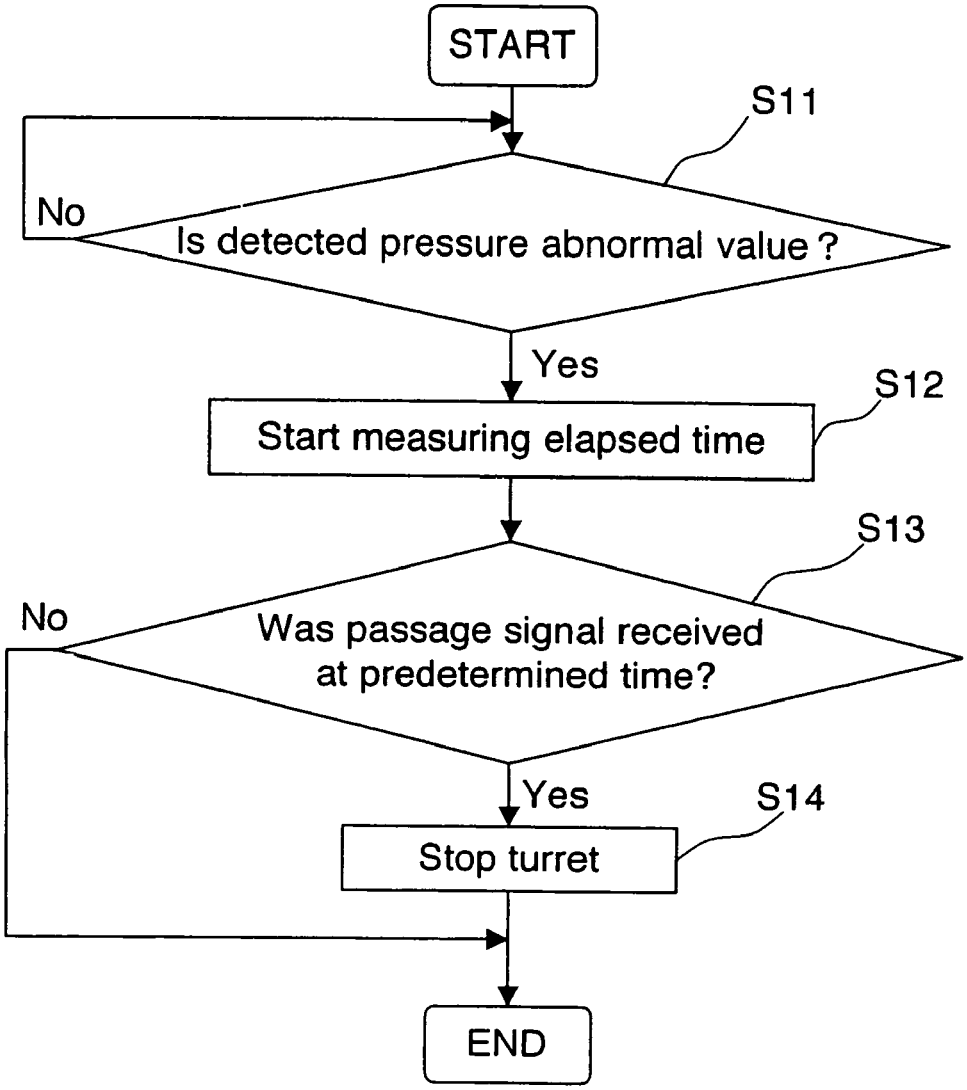
FIG. 8 is a schematic flow chart illustrating a control procedure with a different configuration in the controller shown in FIG. 6.

Although the controller 27 having the separation determination circuit 27*a*, the separation timing circuit 27*b*, and the actuation verification circuit 27*c* has been described in the above embodiment, the configuration may be mainly constituted of a computer system and software may detect the designated molded article, determine the separation timing, and verify the actuation of the separator based on the movement of the molded article (designated molded article) to be separated. In other words, such a controller 28 includes a central processing unit 28*a*, a storage device 28*b*, an input interface 28*c*, and an output interface 28*d* as shown in FIG. 6. Here, the image signals from the high-speed cameras 30 and 31 are analyzed by the image processor and the image processor is included in the central processing unit 28*a*. FIG. 7 is a flow chart illustrating a procedure of detection of the designated molded article and determination of the separation timing and FIG. 8 is a flow chart illustrating a procedure of verification of the actuation of the separator. Because the electric signal output from the load cell 18 is an analog signal, the pressure is detected based on a signal obtained by analog-digital conversion.

Next, the flow chart shown in FIG. 7 will be described.

If the rotary powder compression molding machine operates, the controller 28 executes a control program stored in the storage device 28*b* and detects the pressure based on the input electric signal in step S1. Next, in step S2, the controller 28 determines whether or not the detected pressure is an abnormal value. Here, ranges of the abnormal value are defined by an upper abnormal value and a lower abnormal value. A signal corresponding to the upper separation signal in the above embodiment is set as the upper abnormal value and a signal corresponding to the lower separation signal is set as the lower abnormal signal. If the pressure detected by the controller 28 is higher than or equal to the upper abnormal value or if the detected pressure is lower than or equal to the lower abnormal value, it is determined that the detected pressure is the abnormal value. If the pressure detected by the controller 28 is not the abnormal value, the controller 28 repeatedly performs the determination of the abnormal value in step S2.

Next, if the pressure detected by the controller 28 is the abnormal value, the controller 28 starts counting the pulses included in the pulse train output from the rotary encoder 12 in step S3 based on the determination result in step S2 since the determination result. In step S4, the controller 28 determines whether or not the number of counted pulses is the predetermined number. The predetermined number is the same value as that in the above-described embodiment and is set to the number of pulses corresponding to the angle between the position of pressurization and the designated molded article separating position. Based on this determination, the controller 28 measures the rotation angle of the turret 3. If the number of counted pulses are smaller than the predetermined number, the controller 28 repeatedly performs the determination of the predetermined number in step S4.

If the controller 28 determines that the number of counted pulses has reached the predetermined number in step S4, the control valve 26 is opened for the predetermined time in step S5.

Next, the flow chart in FIG. 8 will be described.

The controller 28 verifies the trouble of the separator in steps S11 to S15 along with the procedure in steps S1 to S5 described above. First, the controller 28 executes the control program and determines whether or not the detected pressure is the abnormal value in step S11. This determination is the same as step S2 described above. If the controller 28 determines that the pressure is the abnormal value, the controller 28 starts counting an elapsed time from detection of the abnormal value in step S12.

Next, in step S13, whether or not the controller 28 received the passage signal from the passage sensor 23 at a predetermined time is determined. If the controller 28 received the passage signal from the passage sensor 23 at the predetermined time, it is determined that the designated molded article followed the same path as the molded articles other than the designated molded article and the stop signal for stopping energization of the motor 8 is output to stop the turret 3 in step S14.

On the other hand, if the controller 28 did not receive the passage signal from the passage sensor 23 at the predetermined time in step S13, it is determined that the designated molded article did not follow the same path as the molded articles other than the designated molded article and it is possible to verify that the separator is actuated normally.

At this time, a normality verification signal may be output.

By detecting the designated molded article, measuring the rotation angle of the turret 3, and verifying the actuation of the separator with the software in this way, it is possible to simplify the configuration of the controller 28.

The invention is not limited to the above-described embodiment.

Although the rotary encoder for outputting at least one pulse train has been described in the above-described embodiment, it may be an incremental rotary encoder for outputting two pulse trains out of phase with each other or an absolute rotary encoder for outputting a code signal and especially a gray code, a binary code, a binary coded decimal code, and the like.

In the above-described embodiment, the actuation of the separator may be verified based on the elapsed time from detection of the abnormality of the pressure in molding the powder material or the actuation of the separator may be verified based on the elapsed time from the designated molded article separating position and a starting point of the elapsed time is arbitrary. In particular, it is implemented by executing a control program with content shown in the flow chart in FIG. 9 in the controller 28 shown in FIG. 6.

Figure 9:
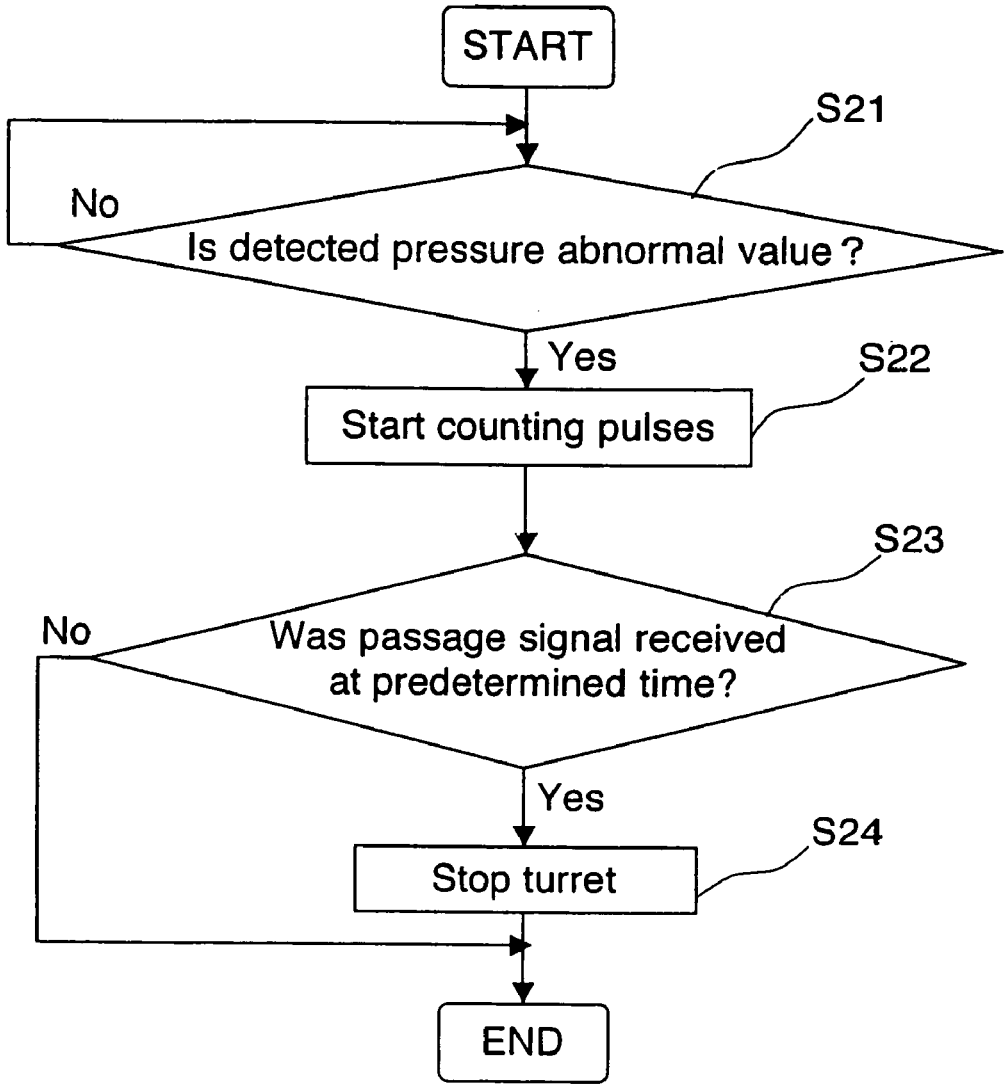
FIG. 9 is a schematic flowchart illustrating a variation of the example shown in FIG. 8.

The flow chart shown in FIG. 9 will be described.

If the controller 28 determines that the detected pressure in molding is the abnormal value in step S21, it starts counting of the pulses output from the rotary encoder 12 in step S22. When the number of counted pulses reaches the predetermined number, whether or not the controller 28 received the passage signal from the passage sensor 23 at the predetermined time is determined in step S23. If the controller 28 received the passage signal from the passage sensor 23 at the predetermined time, it is determined, that the path of the designated molded article after passage through the designated molded article separating position is the same as the path of the molded articles other than the designated molded article. Then, in step S24, because the separator has not been actuated normally, the controller 28 outputs the stop signal in order to stop the turret 3.

On the other hand, if the controller 28 did not receive the passage signal from the passage sensor 23 at the predetermined time in step S23, it is determined that the designated molded article is not following the same path as the molded articles other than the designated molded article and it is possible to verify that the separator has been actuated normally.

At this time, the normality verification signal may be output.

In this control program, the predetermined number of the counted pulses is set to the number of pulses output when the turret 3 rotates since the detection of the abnormal pressure until the designated molded article reaches the position where the passage sensor 23 is disposed.

Although the passage sensor is configured to detect the movement of the molded article by utilizing reflection of the light in the above-described embodiment, it may include a light-emitting device and a light-receiving device facing each other and detect the movement of the molded article when the molded article passes between the light-emitting device and the light-receiving device. This type of passage sensor 23 may be provided in a position at the tip end 22*a* of the air passage 22 and closer to the molded article collecting position 20. In the latter configuration, it is determined that the separator has not been actuated normally when the passage sensor 23 detects the passage of the designated molded article.

The passage sensors 23 and 29 may be sensors or switches that are actuated when the designated molded article collides with them. Instead of the optical sensors, sensors using electromagnetic waves or sensors using ultrasonic waves may be used.

As the designator for sampling the molded article, an input device such as a keyboard, a mouse, a card leader, or the like, for inputting information for specifying the molded article to be designated is suitable.

Specific configurations of other respective portions are not limited to those in the embodiment either and the invention may be modified in various ways within a range not departing from the purposes thereof.

As an application of the invention, the invention can be applied to a tablet producing machine, an electronic component producing machine, or a food producing machine that compresses the powder material as an ingredient to produce products.

What is claimed is:

1. A rotary powder compression molding machine, comprising:

a frame;

a rotary shaft rotatably mounted in the frame;

a turret mounted to the rotary shaft;

a plurality of dies provided at predetermined intervals in a circumferential direction of the turret;

an upper punch and a lower punch retained in positions above and below each of the dies to he movable in a vertical direction;

an upper roll and a lower roll for biasing the upper punch and the lower punch toward each other with tip ends of the upper punch and the lower punch inserted in the die to compress a powder material filled in the die;

a designator for designating a molding portion constituted of a set of the die and the upper and lower punches corresponding to the die;

a position detector for detecting that the molding portion designated by the designator has reached a predetermined position;

a separator for separating a designated molded article ejected from the molding portion designated by the designator from collection of molded articles other than the designated molded article based on a position detection signal output from the position detector; and an actuation verifier for verifying an actuation of the separator based on a movement of the designated molded article, wherein the actuation verifier includes a passage sensor, which outputs a passage signal when the passage sensor detects a passage of the designated molded article.

2. A rotary powder compression molding machine according to claim 1, wherein the actuation verifier outputs an abnormality verification signal when it verifies that the separator was not actuated normally.

3. A rotary powder compression molding machine according to claim 1, wherein the actuation verifier outputs a normality verification signal when it verifies that the separator was actuated normally.

4. A rotary powder compression molding machine according to claim 1, wherein the designator includes a pressure detector for detecting that a pressure applied on the powder material when the upper punch and the lower punch pass between the upper roll and the lower roll comprises a predetermined pressure.

5. A rotary powder compression molding machine according to claim 1, wherein the position detector includes an angle measure for measuring a rotation angle of the turret.

6. A rotary powder compression molding machine according to claim 1, wherein the position detector includes a pulse measure for measuring a position of the molding portion by measuring pulses generated by a rotation of the turret.

7. A rotary powder compression molding machine according to claim 6, wherein the pulse measure includes a rotary encoder for detecting a rotation angle of the rotary shaft.

8. A rotary powder compression molding machine according to claim 1, further comprising a separation determination circuit for outputting a counting start signal based on the position detection signal output from the position detector, wherein the passage sensor outputs the passage signal when the passage sensor detects the passage of the designated molded article, in a predetermined position in a vicinity of a tip end of an air passage of a guide member and checks the counting start signal and the passage signal against each other to output an abnormality verification signal or a normality verification signal.

9. A rotary powder compression molding machine according to claim 8, wherein the actuation verifier further includes a second passage sensor, which is different from the passage sensor, and which is disposed between a designated molded article separating position for separating the designated molded article from the molded articles other than the designated molded article and a designated molded article collecting position for collecting the designated molded article.

10. A rotary powder compression molding machine according to claim 8, wherein a shooting device is mounted in a predetermined position in a vicinity of the passage sensor besides or in a place of the passage sensor and the actuation verifier verifies a passage or a moving direction of a molded article or the designated molded article with the shooting device.

11. A rotary powder compression molding machine according to claim 2, wherein the designator includes a pressure detector for detecting that a pressure applied on the powder material when the upper punch and the lower punch pass between the upper roll and the lower roll comprises a predetermined pressure.

12. A rotary powder compression molding machine according to claim 2, wherein the position detector includes an angle measure for measuring a rotation angle of the turret.

13. A rotary powder compression molding machine according to claim 2, wherein the position detector includes a pulse measure for measuring a position of the molding portion by measuring pulses generated by a rotation of the turret.

14. A rotary powder compression molding machine according to claim 2, further comprising a separation determination circuit for outputting a counting start signal based on the position detection signal output from the position detector, wherein the passage sensor, outputs the passage signal when the passage sensor detects the passage of the designated molded article, in a predetermined position in a vicinity of a tip end of an air passage of a guide member and checks the counting start signal and the passage signal against each other to output an abnormality verification signal or a normality verification signal.

15. A rotary powder compression molding machine according to claim 9, wherein a shooting device is mounted in a predetermined position in a vicinity of the passage sensor beside or in a place of the passage sensor and the actuation verifier verifies the passage or a moving direction of the molded article or the designated molded article with the shooting device.

16. A rotary powder compression molding machine according to claim 10, wherein the shooting device comprises a high-speed camera.

17. A rotary powder compression molding machine according to claim 15, wherein the shooting device comprises a high-speed camera.

18. A method of verifying actuation of molded article separation in a rotary powder compression molding machine, said rotary powder compression molding machine including:

a frame;

a rotary shaft rotatably mounted in the frame;

a turret mounted to the rotary shaft;

a plurality of dies provided at predetermined intervals in a circumferential direction of the turret;

an upper punch and a lower punch retained in positions above and below each of the dies to be movable in a vertical direction;

an upper roll and a lower roll for biasing the upper punch and the lower punch toward each other with tip ends of the upper punch and the lower punch inserted in the die to compress a powder material filled in the die; and a passage sensor, which outputs a passage signal when the passage sensor detects a passage of the designated molded article, wherein the method comprises:

designating a molding portion comprising a set of the die and the upper and lower punches corresponding to the die;

detecting that the designated molding portion has reached a designated molded article separating position;

separating a designated molded article ejected from the designated molding portion from a collection of molded articles other than the designated molded article, based on the designating the molding portion and a result of the detection;

verifying based on the passage signal from the passage sensor, whether the separation has been carried out normally based on a path of the designated molded article; and outputting an abnormality verification signal when the separation was not normal.

19. A method of verifying actuation of molded article separation in a rotary powder compression molding machine, said rotary powder compression molding machine including:

a frame;

a rotary shaft rotatably mounted in the frame;

a turret mounted to the rotary shaft;

a plurality of dies provided at predetermined intervals in a circumferential direction of the turret;

an upper punch and a lower punch retained in positions above and below each of the dies to be movable in a vertical direction;

an upper roll and a lower roll for biasing the upper punch and the lower punch toward each other with tip ends of the upper punch and the lower punch inserted in the die to compress a powder material filled in the die; and a passage sensor, which outputs a passage signal when the passage sensor detects a passage of the designated molded article, wherein the method comprises:

designating a molding portion comprising a set of the die and the upper and lower punches corresponding to the die;

detecting that the designated molding portion has reached a designated molded article separating position;

separating a designated molded article ejected from the designated molding portion from a collection of molded articles other than the designated molded article, based on the designating the molding portion and a result of the detection;

verifying, based on the passage signal from the passage sensor, whether the separation has been carried out normally based on a path of the designated molded article; and outputting a normality verification signal when the separation was normal.

20. A rotary powder compression molding machine according to claim 1, wherein the passage sensor outputs the passage signal when the passage sensor detects the passage of the designated molded article in a predetermined position in a vicinity of a tip end of an air passage of a guide member.

* * * * *